United States Patent [19]

Guidry et al.

[11] Patent Number: 4,747,352

[45] Date of Patent: May 31, 1988

[54] TABLE APPARATUS WITH DISPOSAL ASSEMBLY

[75] Inventors: Ray A. Guidry, Lafayette; James M. Marceaux, Carencro, both of La.

[73] Assignee: Shells & Tails, Inc.

[21] Appl. No.: 627,325

[22] Filed: Jul. 2, 1984

[51] Int. Cl.[4] ..... A47B 35/00

[52] U.S. Cl. ..... 108/50; 108/26

[58] Field of Search ..... 108/50, 49, 24, 26, 108/94

[56] References Cited

U.S. PATENT DOCUMENTS

| | | | |
|---|---|---|---|
| 1,579,823 | 4/1926 | Langguth | 108/26 X |
| 1,584,139 | 5/1926 | Porter | 108/94 |
| 1,876,559 | 9/1932 | Bothwell | 108/26 |
| 1,897,717 | 2/1933 | Appel | 108/26 |
| 1,903,994 | 4/1933 | Goldman | 108/26 X |
| 2,022,591 | 11/1935 | Everitt | 108/24 X |
| 2,508,802 | 5/1950 | Schade | 108/26 |
| 3,951,079 | 4/1976 | Tolleson | 108/94 |
| 4,060,038 | 11/1977 | Ruvolo | 108/94 |
| 4,334,482 | 6/1982 | Bolduc | 108/94 X |

*Primary Examiner*—Kenneth J. Dorner
*Assistant Examiner*—José V. Chen
*Attorney, Agent, or Firm*—Pravel, Gambrell, Hewitt, Kimball & Krieger

[57] ABSTRACT

A table apparatus, particularly suitable for use in the eating of shell seafood, including a table top portion having a recessed central area for placement of the yet eaten seafood items, and a peripheral upper surface area for placement of the utensils and dishes during dining. The table top portion further includes a centrally located rectangular port for accomodating the lower end of a funnel-shaped depository, the upper portion of the depository funnel comprising a plurality of angulated walls for defining a depository for cast off seafood shells and the like to an area beneath the table top. There is further provided on the upper portion of the depository funnel means for accomodating a lazy susan on a central post, the lazy susan rotatable around the axis of the post and adapted to receive condiments and seasoning items on one portion of the susan and rolled paper towels on a second portion. There is further provided hook means at each lower corner of the table top for hanging a bucket for holding cold beverages, and a semicircular guard portion situated so as to receive a trash recepticle beneath the table, the opening of which would be in alignment with the lower most opening of the funnel portion for receiving cast off shells.

1 Claim, 2 Drawing Sheets

TABLE APPARATUS WITH DISPOSAL ASSEMBLY

BACKGROUND OF THE INVENTION

1. Field of the Invention

The apparatus of the present invention pertains to tables. More particularly, the apparatus of the present invention relates to a table having a centrally located disposal assembly for disposing of waste, particularly seafood shells or the like, during dining thereon.

2. General Background

In the art of fine dining, particularly in the dining on shell seafood such as clams, oysters, shrimp, crawfish, mussels, lobsters and crabs, it is somewhat of an inconvenience to dine amongst the non-edible shelled portions of the particular seafood, which often times clutters the table top. In addition, due to the fact that the shelled seafood, prior to be eaten, is often placed on the table until it is eaten, there is a continuing problem of the eaten and uneaten shelled products to become mixed together, creating the uneasy task of having to sort them out in order to find the yet uneaten seafood.

In addition, beverages which are served during the eating of the seafood must by an necessity be maintained off of the tabletop to make room for the used shelled and unshelled seafood, and therefore must be stored in an ice chest or the like near the table in order to have them readily available. This is often inconvenient, and not suitable to easy access.

There are several patents which have been obtained on the subject of tables having certain features which may be pertinent to the present invention, the most pertinent being as follows:

U.S. Pat. No. 1,584,139, issued to Porter, entitled "Bedside Table", teaches the use of a table which has a hole in the center for allowing debris and the like to be thrown through it.

U.S. Pat. No. 2,261,514, issued to Dunigan, entitled "Combined Dining Table, Food Warmer, and Lamp" teaches the use of a table having a rotating auxiliary container for the placement of food and the like.

U.S. Pat. No. 1,903,419, issued to Keller, entitled "Combination Table Top and Rotatable Tray" also teaches the use of an apparatus having a rotatable tray for serving food and the like from.

U.S. Pat. No. 2,181,318, issued to Johnson, entitled "Cleansing Tissue Holder", teaches the use of a holder for tissue and the like.

U.S. Pat. No. 2,059,957, issued to Mendenhall, et. al, entitled "Obstetric Table"; U.S. Pat. No. 2,022,591, issued to Everitt, entitled "Combination Service Table, Drain and Conveyor"; U.S. Pat. No. 1,106,057, issued to Puckett, entitled "Supporting Table", and U.S. Pat. No. 1,897,717, issued to Appel, entitled "Table Attachment", all teach the use of a type of table for supporting and serving.

SUMMARY OF THE INVENTION

The apparatus of the present invention offers an unique solution to the problems confronted in the present state of the art. What is provided is a table apparatus, particularly suitable for use in the eating of shell seafood, including a table top portion having a recessed central area for placement of the yet eaten seafood items, and a peripheral upper surface area for placement of the utensils and dishes during dining. The table top portion further includes a centrally located rectangular port for accomodating the lower end of a funnel-shaped depository, the upper portion of the depository funnel comprising a plurality of angulated walls for defining a depository for cast off seafood shells and the like to an area beneath the table top. There is further provided on the upper portion of the depository funnel means for accomodating a lazy susan on a central post, the lazy susan rotatable around the axis of the post and adapted to receive condiments and seasoning items on one portion of the susan and rolled paper towels on a second portion. There is further provided hook means at each lower corner of the table top for hanging a bucket for holding cold beverages, and a semicircular guard portion situated so as to receive a trash receptacle beneath the table, the opening of which would be in alignment with the lower most opening of the funnel portion for receiving cast off shells.

Therefore, it is an object of the present invention to provide a table particularly suitable for eating shell seafood.

It is still a further object of the present invention to provide a table for eating seafood which isolates the unshelled seafood from the shelled food being eaten and the shells as cast off following eating. It is still a further object of the present invention to provide a seafood table wherein condiments and towels or napkins are readily available to all individuals seated at the table.

It is a further object of the present invention to provide a centrally located depository for cast off shells or the like.

In order to accomplish the above noted object of the present invention, it is a principal feature of the present invention to provide a seafood table having a table top, a portion of which is recessed for separating the eaten and uneaten seafood.

It is an additional principal feature of the present invention to provide a funnel apparatus insertable into a central port on the seafood table top for depositing waste seafood shells or the like to an area beneath the table top.

It is still a further principal feature of the present invention to provide a rotatable lazy susan mounted on the depository funnel easily accessible to all sitting at the table for obtaining napkins and seasoning therefrom.

DETAILED DESCRIPTION OF THE PREFERRED EMBODIMENT

Figure 1:
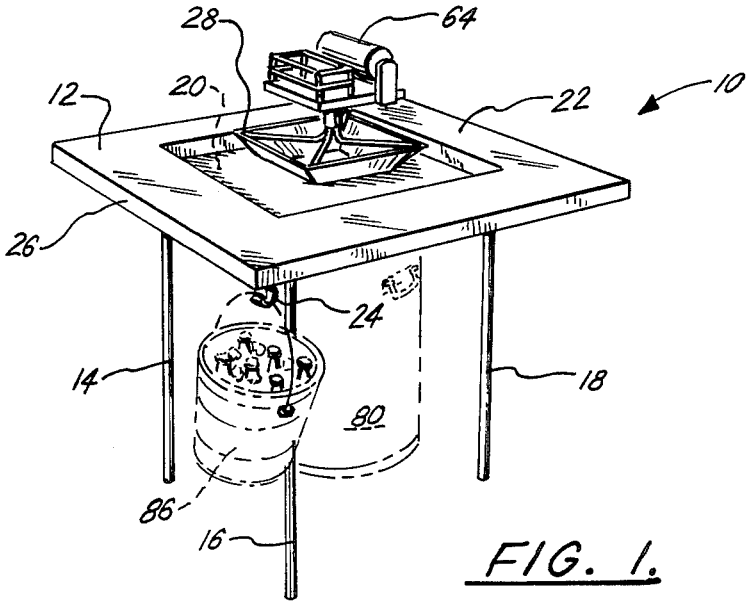
FIG. 1 is an overall perspective view of the preferred embodiment of the apparatus of the present invention.

FIGS. 1 through 7 illustrate the preferred embodiment of the apparatus of the present invention as designated by the numeral 10. In the preferred embodiment, seafood table apparatus 10 would comprise a table top portion 12 supported by plurality of legs 14, 16, 18 and 19 (not shown). As seen particularly in FIGS. 1 and 4, table top 12 generally comprises a centrally located recessed means 20 which, in the preferred embodiment, would be an area recessed approximately one to two inches, and would define a central seafood receiving portion 20 during use. Table top 12 further provides an outer most peripheral raised section 22 which defines the main dining portion of the table top 12. As seen in top view, table top 12 further provides a centrally located preferably square port 24, the function of which will be described further. As seen in FIG. 1, there is further provided a downward depending boarder 26 around the entire table top for aesthetic purposes.

Figure 2:
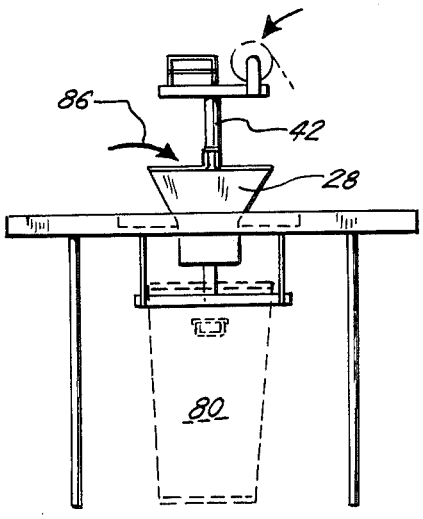
FIG. 2 is a side view of the preferred embodiment of the apparatus of the present invention.
Figure 3:
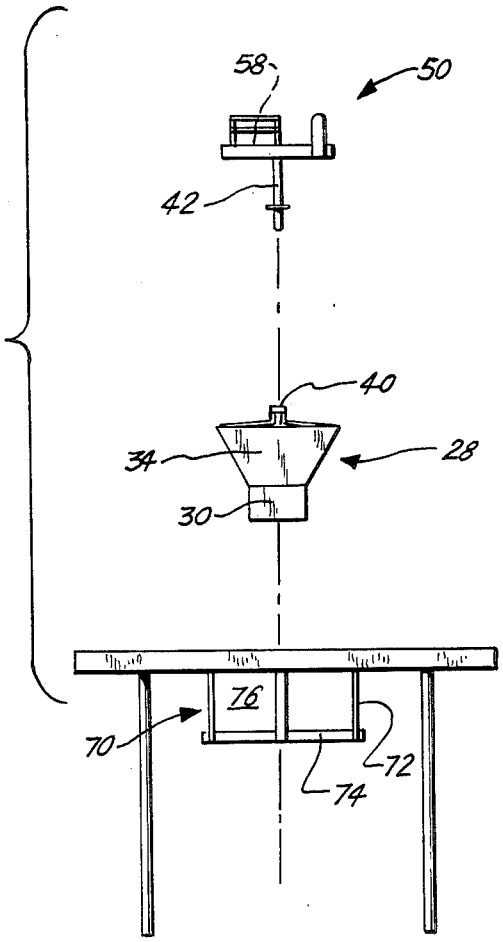
FIG. 3 is an exploded view of the preferred embodiment of the apparatus of the present invention.
Figure 5:
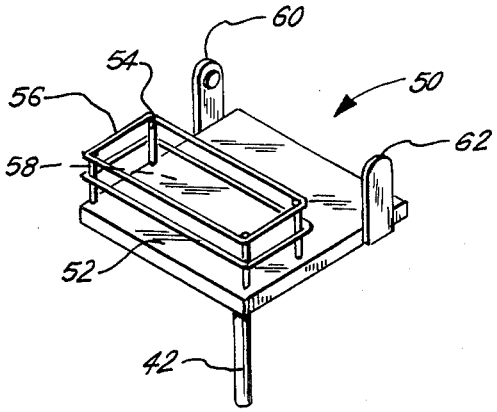
FIG. 5 is a overall perspective view of the "Lazy Susan" portion of the preferred embodiment of the apparatus of the present invention.
Figure 6:
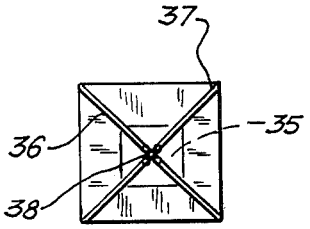
FIG. 6 is a top view of the depository funnel portion of the preferred embodiment of the apparatus of the present invention.
Figure 7:
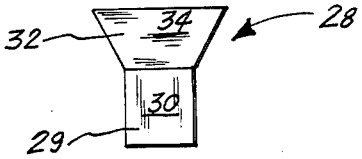
FIG. 7 is a side view of the depository funnel of the preferred embodiment of the apparatus of the present invention.

Turning now to FIGS. 2 through 7, and making reference to port 24, port 24 is designed to accomodate the shell waste receiving means as defined by the funnel portion 28 as seen in top and side views respectively in FIGS. 6 and 7. As seen particularly in FIG. 7, funnel portion 28 would further include a lower most portion 29 having four rectangular vertical side walls 30 integrally connected to upper portion 32 which includes four angulated side walls 34, the bottom most portion 29 defining that portion of funnel 28 insertable into port 24, and the upper portion 32 defining the shell receiving means of funnel 28 as will be described further. Of course, funnel portion 28 further includes a central opening 35, which is illustrated in FIG. 6, for allowing shells or the like deposited therein to fall therethrough. FIG. 2 further illustrates funnel 28 in position in port 24 during use of the apparatus. As seen in FIG. 2 and FIG. 6, funnel portion 28 further includes an upper rectangular bracket support 36 which includes four metal rods or the like rigidly attached, through welding or the like, at each corner 37 of the upper most portion of portion 34 of funnel 28 and converging at the central portion 38 for housing a central receiving ring 40 for receiving post member 42 of lazy susan 50 as seen in FIG. 3, allowing 360° rotation of lazy susan 50. Again, FIG. 2 further illustrates the position of lazy susan 50 perched atop post 42 and funnel portion 28.

FIG. 5 illustrates in detail lazy susan 50, which includes again a central post portion 42 insertable into central ring 40 of funnel portion 28, as described earlier. The upper most portion of post 42 is rigidly attached to the body plate member 52 which on its upper surface includes means for receiving and housing condiments or seasoning bottles, the means comprising a plurality of four corner posts 54 and a continuous metal bar portion 56 defining an enclosed space 58 wherein the condiments and the like are maintained. The second portion of lazy susan 50 includes a pair of brackets 60 and 62 adapted for rotatively receiving a roll of paper towels or the like 64 as seen in FIG. 1 for easy access thereto. In the preferred embodiment, again as seen in FIG. 1, lazy susan 50 as mounted via posts 42 within receiving range 38 has the ability to rotate about a 360° degree axis for easy access to the condiments or paper towels for anyone seated at the table.

Figure 4:
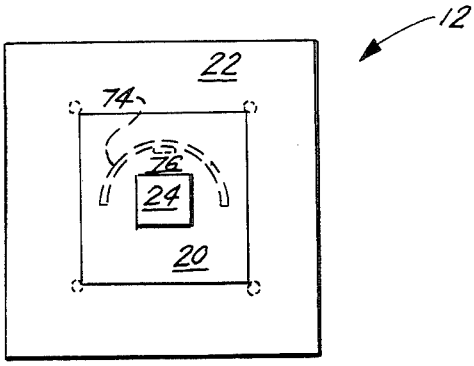
FIG. 4 is a top view of the preferred embodiment of the apparatus of the present invention.

As seen particularly in FIGS. 3 and 4, table apparatus 10 further comprises a trash receptacle receiving portion 70, which is mounted on the underside of table top 12, the receptacle receiving means further comprising a plurality of downwardly depending bracket members 72 and an interconnecting member 74 semicircularly and rigidly attached to each of said members 72 for defining a semicircular receiving space 76 therein. As seen in phatom view both in FIG. 1 and 2, a trash receptacle 80 is easily insertable into the space 76 and once the wall of the receptacle 80 is placed in contact with the semicircular bracket 74, one is assured that the receiving space of the receptacle is in complete alignment with port 24 of table top 12.

As seen in FIG. 1, there is further provided a hook means 84 also contained on the underside of each corner of table top 12 for accomodating a bucket 86 or the like for having easy access to beverages, such as beer or soft drinks.

In use of the table top 10, it should be noted that shell seafood, for example crabs or crawfish, are deposited within recess area 20 of table top 12 with disposal funnel portion 28 mounted within port 24 so that lower portion 30 thereof extends below the lower most portion of table top 12 as seen in FIG. 2. Also, lazy susan 50 is mounted thereupon containing the paper towels 64 and condiments or the like within receiving space 58. Following the depositing of the seafood or the like in space 20, individuals dining around the peripheral of table top 12, achieve the actual eating on raised portion 22, and rather than shells or the like being redeposited into space 20, the shelled waste portions are then dropped into funnel portion 28 as seen via arrow 86 in FIG. 2, and having placed receptacle 80 in position beneath table 10 as seen in FIGS. 1 and 2, the waste is deposited through funnel 28 into receptacle 80. Therefore, the uneaten seafood is kept separate and apart from the seafood being eaten, and the waste being extracted therefrom during the eating process. This unique arrangement enables individuals enjoying shelled seafood to be unhampered by the clutter of both the uneaten and the waste shells of the seafood.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A seafood table particularly suitable for the eating of shell seafood, comprising:

a. a substantially rectangular table top portion, having a perimeter section around the entire exterior of the table portion for accommodating seafood while being eaten, and a recessed section interior to the raised perimeter section for defining an area for accommodating seafood yet to be eaten;

b. a port situated in the recessed area of the top portion for disposing of shell waste therewithin;

c. a removable funnel shaped member, insertable into the port, and extruding above the top portion, for receiving the shell waste deposited therewithin from the top portion of the table to an area beneath the table, and for further preventing the seafood situated in the recessed portion from inadvertently falling into the port ; and d. storage means, mounted on the funnel shaped portion for accommodating condiments and towels accessible to individuals seated at the table.

* * * * *